United States Patent [19]

Hirahara et al.

[11] Patent Number: 4,764,097

[45] Date of Patent: Aug. 16, 1988

[54] TWO-CYLINDER TYPE ROTARY COMPRESSOR

[75] Inventors: Takuho Hirahara, Shizuoka; Susumu Kawaguchi, Fujieda; Sei Ueda, Shimizu; Kazuhiro Nakane, Shizuoka, all of Japan

[73] Assignee: Mitsubishi Denki Kabushiki Kaisha, Tokyo, Japan

[21] Appl. No.: 27,056

[22] Filed: Mar. 23, 1987

Related U.S. Application Data

[63] Continuation of Ser. No. 792,839, Oct. 30, 1985, abandoned.

[30] Foreign Application Priority Data

Nov. 22, 1984 [JP] Japan ..... 59-247725

[51] Int. Cl.[4] ..... F04C 23/00; F04B 11/00

[52] U.S. Cl. ..... 418/60; 417/540; 417/902

[58] Field of Search ..... 418/60, 212, 213, DIG. 1; 417/540, 542, 902

[56] References Cited

U.S. PATENT DOCUMENTS

| | | | |
|---|---|---|---|
| 1,609,364 | 12/1926 | Klinge | 418/60 |
| 2,548,472 | 4/1951 | Gibson | 417/542 |
| 3,125,031 | 3/1964 | Rydberg et al. | 418/60 |
| 3,314,370 | 4/1967 | Jacobs | 418/60 |
| 3,617,158 | 11/1971 | Yamamoto et al. | 418/11 |
| 4,281,972 | 8/1981 | Jacobs | 417/902 |
| 4,452,571 | 6/1984 | Koda et al. . | |
| 4,601,644 | 7/1986 | Gannaway | 417/902 |

FOREIGN PATENT DOCUMENTS

| | | | |
|---|---|---|---|
| 1703004 | 7/1955 | Fed. Rep. of Germany . | |
| 2602582 | 10/1977 | Fed. Rep. of Germany . | |
| 2650936 | 3/1978 | Fed. Rep. of Germany . | |
| 55-96393 | 7/1980 | Japan . | |
| 59-147895 | 8/1984 | Japan | 418/60 |

*Primary Examiner*—John J. Vrablik

*Attorney, Agent, or Firm*—Oblon, Fisher, Spivak, McClelland & Maier

[57] ABSTRACT

A two-cylinder type rotary compressor has two compression elements each provided with a cylinder. First and second intake conduits are respectively formed in the cylinders so as to be in parallel to an intermediate partition plate disposed between the cylinders. Each one end of first and second intake tubes is connected to each of the intake conduits and each other end of the intake tubes is connected to a common intake pipe which is provided outside a hermetic casing.

1 Claim, 5 Drawing Sheets

TWO-CYLINDER TYPE ROTARY COMPRESSOR

This application is a continuation of application Ser. No. 792,839, filed on Oct. 30, 1985, now abandoned.

BACKGROUND OF THE INVENTION

1. Field of the Invention

The present invention relates to a two-cylinder type rotary compressor used mainly for a refrigerating apparatus or an air conditioning apparatus. More particularly, it relates to a two-cylinder type rotary compressor for reducing pressure loss in a cooling medium intake system.

2. Discussion of the Background

FIGS. 7 and 8 show a conventional two-cylinder type rotary compressor disclosed in Japanese Unexamined Utility Model Publication No. 50793/1981. In FIGS. 7 and 8, a reference numeral 1 designates a driving shaft having eccentric portions 1*a*, 1*b*, numerals 2*a*, 2*b* respectively designate cylinders each provided with compression chamber 3*a* or 3*b*, numerals 4*a*, 4*b* designate rolling pistons driven by the eccentric portions 1*a*, 1*b*, numerals 5*a*, 5*b* designate vanes which are usually in contact with the outer circumferential surface of the rolling pistons, numerals 6*a*, 6*b* designate springs for pushing the vanes 5*a*, 5*b*, numerals 7, 8 designate bearing plates which cooperate with the cylinders 2*a*, 2*b* to form a compression chamber at the inner side of each of the cylinders 2*a*, 2*b*, a numeral 9 designates an intermediate partition plate disposed between the cylinders 2*a*, 2*b* and separates the compression chambers 3*a*, 3*b* at both sides of the plate, a numeral 10 designates a hermetic casing for receiving the two compression elements A, B constructed as above-mentioned, and a numeral 13 designates an intake pipe for a low pressure refrigerant gas which has at one end branched portions which are connected to intake conduits 14, 15 formed in the intermediate partition plate 9.

The operation of the conventional rotary compressor having the construction as above-mentioned will be described.

On actuation of the driving shaft 1, rolling pistons 4*a*, 4*b* undergo rolling movement along the inner circumferential surface of the cylinders 2*a*, 2*b*. A low pressure refrigerant gas is sucked in a low pressure sections of the compression chambers 3*a*, 3*b* through the intake pipe 13 and the intake conduits 14, 15 as indicated by arrow marks in FIG. 8. The low pressure refrigerant gas is compressed in the compression chambers 3*a*, 3*b* to become a high temperature and high pressure refrigerant gas and is discharged through a discharge pipe.

In the conventional rotary compressor, complicated machining operations are required since the intake conduits for the refrigerant gas have to be formed in the intermediate partition plate 9. Further, there arises a problem of pressure loss in the intake conduits in the case that a rotary compressor having a large capacity is to be manufactured. To eliminate such disadvantage, it is necessary to form a thick intermediate partition plate so that the inner diameter of the intake conduits is made large. However, this expedient increases a distance between the bearing plates 7 and 8 of the driving shaft, whereby partial abrasion takes place in the bearing plates due to deflection of the driving shaft, this inviting reduction in reliability of the bearing plates and the driving shaft.

SUMMARY OF THE INVENTION

It is an object of the present invention to provide a two-cylinder type rotary compressor facilitating machining operations for intake conduits and reducing pressure loss in an air intake system.

The foregoing and the other objects of the present invention have been attained by providing a two-cylinder type rotary compressor comprising two cylinders providing first and second compression chambers and an intermediate partition plate disposed between the two cylinders to divide them, characterized by comprising an intake conduit for a low pressure refrigerant gas formed in each of said cylinders in parallel to the intermediate partition plate, an intake pipe for common use to introduce the refrigerant gas, the intake pipe being arranged outside a hermetic casing which contains the cylinders and the intermediate partition plate, first and second intake tubes each having one end connected to the intake pipe and each having an other end being passed through the hermetic casing and connected to an opening of each of the intake conduits.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Referring now to the drawings, wherein like reference numerals designate identical or corresponding parts throughout the several views, there is shown in FIG. 1 a first embodiment according to the present invention.

Figure 1:
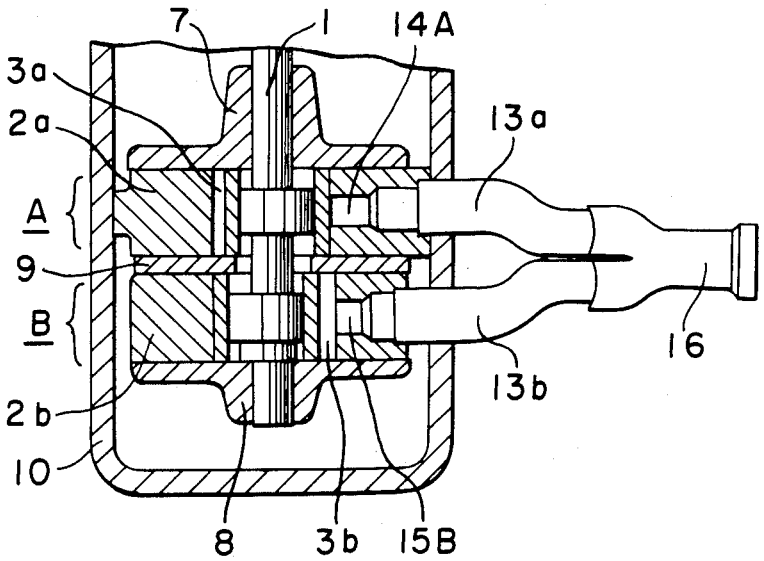
FIG. 1 is a cross-sectional view of an important part of a first embodiment of the two-cylinder type rotary compressor according to the present invention.

The first intake conduit 14A for introducing a refrigerant gas into a compression element A and the second intake conduit 15B for introducing the refrigerant gas into a compression element B are formed in cylinders 2*a*, 2*b* so as to be substantially parallel to an intermediate partition plate 9 placed between the cylinders 2*a*, 2*b*, each of the first and second intake conduits respectively having a linear axial center line. One end of each of first and second intake tubes 13*a*, 13*b* is fitted to each of the first and second intake conduits 14A, 15B. Each other end of the intake tubes 13*a*, 13*b* is extended passing through a hermetic casing 10 to the exterior of the casing where it is connected to a forked portion of a common intake pipe 16. Accordingly, in the two-cylinder type rotary compressor of the present invention, a low pressure refrigerant gas is on one hand introduced in a compression chamber 3a through the intake tube 13a and the intake conduit 14A and is on the other hand introduced in a compression chamber 3b through the intake tube 13b and the intake conduit 15B, after having been passed through the common intake pipe 16.

In the two-cylinder type rotary compressor of the present invention, machining operations for forming the intake conduits 14A, 15B can be easy since each of the conduits 14A, 15B is formed in respective ones of the cylinders 2a, 2b. Further, the inner diameter of the conduits can be sufficiently large regardless of the thickness of the intermediate partition plate 9. In addition, the axial center of each of the intake tubes 13a, 13b is in alignment with the axial center of each of the intake conduits 14A, 15B so as to directly open in each of the compression chambers 3a, 3b. Accordingly, flow passages having small pressure loss can be provided.

Figure 2:
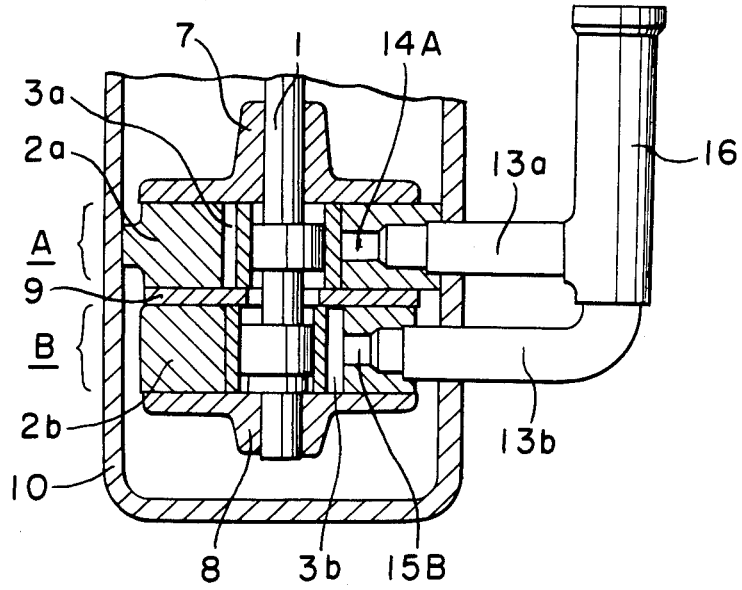
FIG. 2 is a cross-sectional view of a second embodiment according to the present invention.

FIG. 2 shows the second embodiment according to the present invention. The second embodiment is characterized in that an end of the second intake tube 13b having a 90° curved position is connected to an end opening of the common intake pipe 16, while the other end of the intake tube 13b is connected to the intake conduit 15B, and the first intake tube 13a is straight, one end of which is connected to the outer cylindrical surface of the common intake pipe 16 so as to be branched perpendicular to the intake pipe 16. In this embodiment, it is unnecessary to prepare a forked pipe body to be fitted to the end of the common intake pipe 16 as shown in FIG. 1. Accordingly, construction of an intake piping system is simplified.

Figure 3:
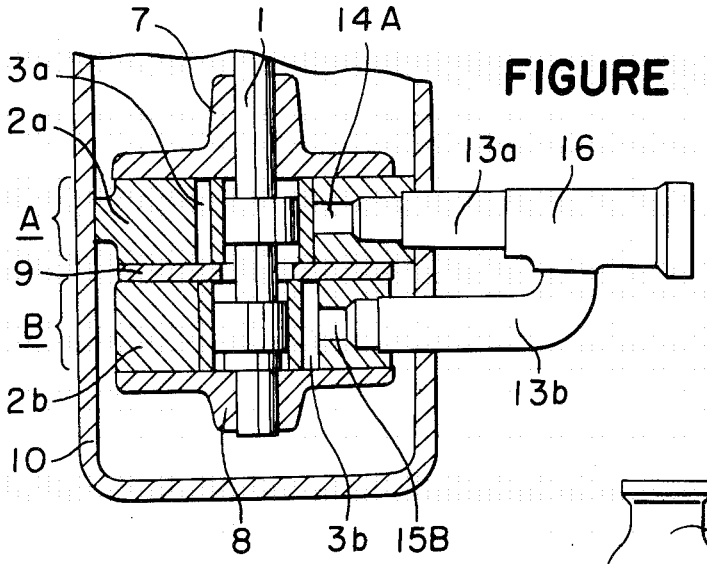
FIG. 3 is a cross-sectional view of a third embodiment according to the present invention.

FIG. 3 shows the third embodiment according to the present invention. In this embodiment, the first intake tube 13a is connected to the end opening of the common intake pipe 16 and extends on the same axial line of the common intake pipe 16. On the other hand, the second intake tube 13b is connected at one end to an opening formed in the outer circumferential surface of the common intake pipe 16 and has a 90° curved position connected to an opening formed in the outer cylindrical surface of the intake pipe 16 so that it extends parallel to the first intake tube 13a. In the third embodiment, pressure loss can be reduced in comparison with the second embodiment shown in FIG. 2.

Figure 4:
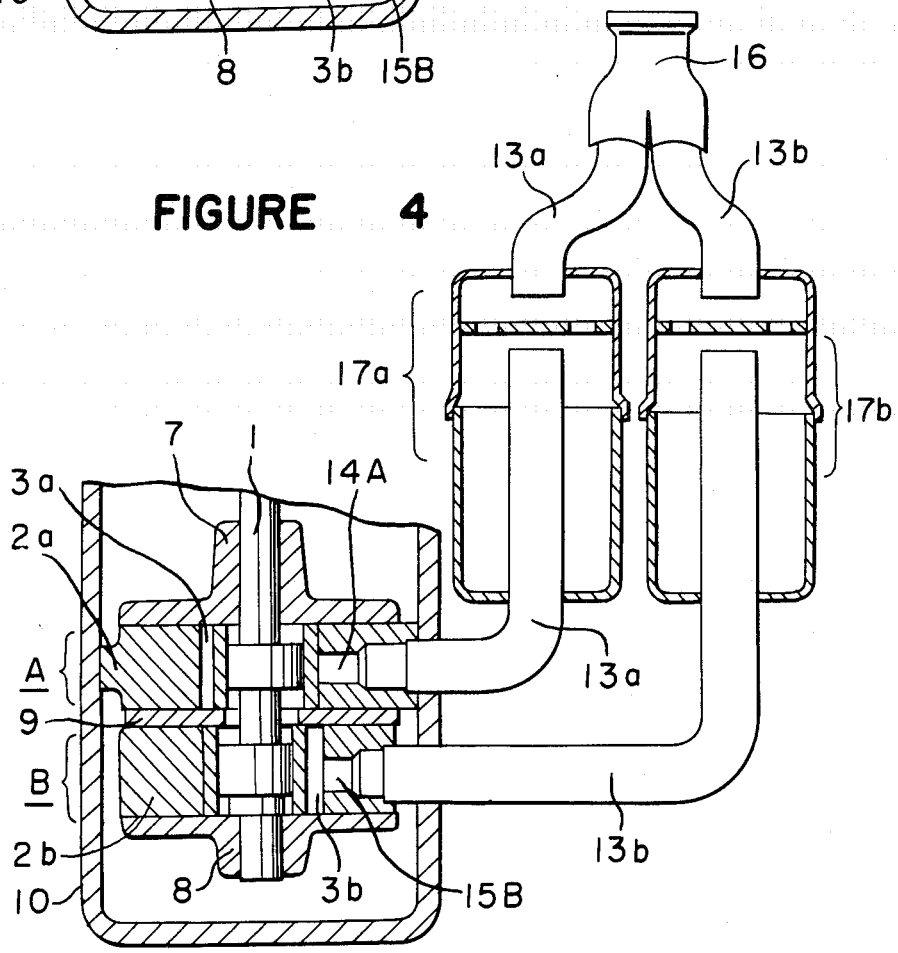
FIG. 4 is a cross-sectional view of a fourth embodiment according to the present invention.

FIG. 4 shows the fourth embodiment according to the present invention. In the embodiment, first and second accumulators 17a, 17b which have a function of gas-liquid separation are respectively interposed at suitable portions in the intake tubes 13a, 13b.

Figure 5:
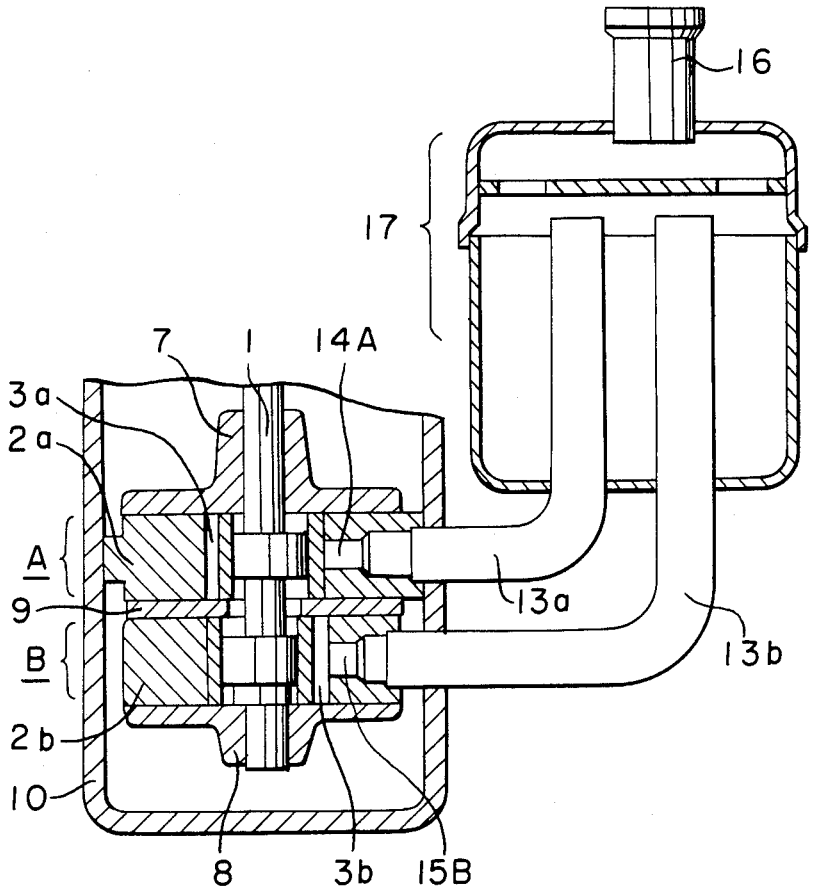
FIG. 5 is a cross-sectional view of a fifth embodiment according to the present invention.

FIG. 5 shows the fifth embodiment according to the present invention. In this embodiment, the intake tubes 13a, 13b are connected to the common intake pipe 16 through a common accumulator 17. In the fifth embodiment, machining of the common intake pipe 16 is simplified since a single accumulator is used.

Figure 6:
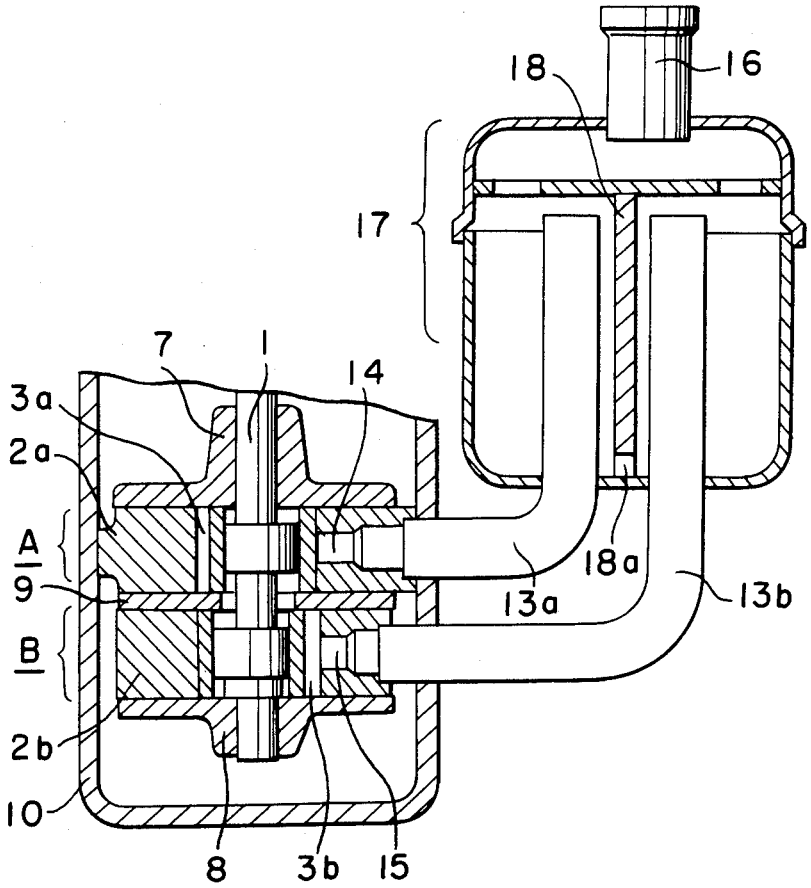
FIG. 6 is a cross-sectional view of a sixth embodiment according to the present invention.
Figure 7:
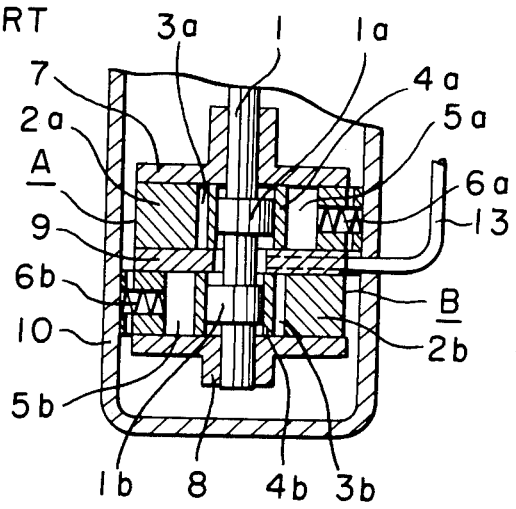
FIGURE 7 PRIOR ART
FIG. 7 is a cross-sectional view of an important part of a conventional two-cylinder type rotary compressor.
Figure 8:
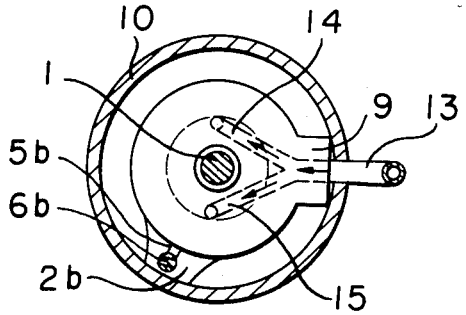
FIGURE 8 PRIOR ART
FIG. 8 is a transverse cross-sectional view of the conventional rotary compressor shown in FIG. 7.

FIG. 6 shows the sixth embodiment according to the present invention. The sixth embodiment is substantially same as the fifth embodiment provided that the interior of the accumulator 17 is divided by a dividing plate 18 into two sections, and the first and second intake tubes 13a, 13b are respectively received in the separated sections. Accordingly, interference of the refrigerant gas discharged from the opening of the intake tubes 13a, 13b in the accumulator 17 is prevented, hence, efficiency of intaking the refrigerant gas of the compressor is increased. In this embodiment, a communication gap 18a may be formed at the lower portion of the dividing plate 18. The communication gap 18a prevents uneven level of liquid at both sections partitioned by the dividing plate when a liquid refrigerant is stored in the accumulator 17.

Thus, in accordance with the two-cylinder type rotary compressor of the present invention, an intake conduit for a refrigerant gas is formed in each of two cylinders so as to be substantially parallel to an intermediate partition plate disposed between the cylinders; first ends of intake tubes are inserted in the opening of each of the intake conduits and the other end of the tubes are extended passing through a hermetic casing to the outside of it and are connected directly, or through a single or separate accumulators, to a common intake pipe. Accordingly, machining operations for the intake conduits can be easy; the thickness of the intermediate partition plate used can be small and the inner diameter of the intake conduit can be sufficiently large whereby pressure loss in an intake piping system can be reduced. Hence, efficiency of the compressor is increased. Further, since the distance between bearing plates can be small, there is no problem of deflection of a driving shaft.

Obviously, numerous modifications and variations of the present invention are possible in light of the above teachings. It is therefore to be understood that within the scope of the appended claims, the invention may be practiced otherwise than as specifically described herein.

We claim:

1. A two-cylinder type rotary compressor comprising:

a hermetic casing;

first and second cylinders disposed in said casing, each said cylinder having an outer wall and an inner wall defining a central opening, there being an intake conduit formed in each said cylinder and extending substantially radially therein between openings in said outer and inner walls, said intake conduits extending in substantially the same directions and having substantially parallel and linear axial center lines;

movable means disposed in said central openings of said cylinders and cooperating with said inner walls to define compression chambers;

an intermediate partition plate disposed between said cylinders and substantially parallel to said intake conduits of said cylinders, said partition plate being a substantially solid and substantially annular body of material having first and second surfaces respectively in contact with said first and second cylinders and having a thickness as measured in an axial direction of said cylinders that is substantially less than a thickness of either of said cylinders as measured in said axial direction;

first and second intake tubes, said intake tubes passing through said casing and extending respectively at least to said outer walls of said cylinders, said intake tubes respectively comprising a direct fluid passage from first ends of said tubes into said intake conduits of said cylinders, portions of said intake tubes proximate said first ends thereof having substantially parallel axial center lines in respective alignment with said axial center lines of said intake conduits; and a common accumulator, second ends of said intake tubes being disposed in said common accumulator, said intake tubes extending to said common accumulator along substantially parallel paths, said common accumulator having a common intake pipe in fluid communication with said second ends of both said first and second intake tubes, said common intake pipe and said second ends of said intake tubes being disposed externally of said casing.

* * * * *